United States Patent [19]

Hoke

[11] Patent Number: 4,714,561

[45] **Date of Patent: * Dec. 22, 1987**

[54] ACYLATED ETHER AMINE AND LUBRICANTS AND FUELS CONTAINING THE SAME

[75] Inventor: Donald I. Hoke, Chagrin Falls, Ohio

[73] Assignee: The Lubrizol Corporation, Wickliffe, Ohio

[ * ] Notice: The portion of the term of this patent subsequent to Apr. 8, 2003 has been disclaimed.

[21] Appl. No.: 844,903

[22] Filed: Mar. 27, 1986

Related U.S. Application Data

[60] Division of Ser. No. 560,254, Dec. 9, 1983, Pat. No. 4,581,038, which is a continuation of Ser. No. 298,449, Sep. 1, 1981, abandoned.

[51] Int. Cl.[4] ..... C10M 133/56; C10M 133/16

[52] U.S. Cl. ..... 252/51.5 A; 252/54.6

[58] Field of Search ..... 252/51.5 A; 44/63

[56] References Cited

U.S. PATENT DOCUMENTS

| | | | |
|---|---|---|---|
| 3,219,666 | 11/1965 | Norman et al. | 252/51.5 A |
| 4,098,585 | 7/1978 | Vartanian et al. | 252/51.5 A |
| 4,104,182 | 8/1978 | Chou et al. | 252/51.5 A |
| 4,237,022 | 12/1980 | Barrer | 252/51.5 A |
| 4,282,007 | 8/1981 | Sung | 44/53 |
| 4,326,987 | 4/1982 | Hendricks et al. | 252/56 D |
| 4,348,210 | 9/1982 | Sung | 44/53 |

*Primary Examiner*—William R. Dixon, Jr.
*Assistant Examiner*—Ellen McAvoy
*Attorney, Agent, or Firm*—James L. Cordek; Denis A. Polyn; Joseph P. Fischer

[57] ABSTRACT

Novel additive compositions are provided comprising the reaction product of a mixture of reactants comprising (A) an unsubstituted or aliphatic hydrocarbon based substituted succinic acylating agent and (B) an ether amine. Fuels and lubricants containing said novel additive compositions are also described.

21 Claims, No Drawings

ACYLATED ETHER AMINE AND LUBRICANTS AND FUELS CONTAINING THE SAME

This is a divisional application of U.S. Ser. No. 560,254 filed Dec. 9, 1983 now U.S. Pat. No. 4,581,038 which is a continuation of U.S. Ser. No. 298,449 filed Sept. 1, 1981, now abandoned.

FIELD OF THE INVENTION

This invention relates to novel additive compositions for use in lubricants and normally liquid fuels. More particularly, this invention relates to novel additive compositions derived from the interreaction of an unsubstituted succinic acylating agent or an aliphatic hydrocarbon based substituted acylating agent and an ether amine, to concentrates thereof and to lubricants and normally liquid fuels containing said additive compositions.

DESCRIPTION OF THE PRIOR ART

It is well-known that lubricants and normally liquid fuels can cause corrosion of various materials with which they may be brought into contact. For example, it is well-known that normally liquid fuels tend to accumulate considerable quantities of water during storage and when subsequently brought into contact with metal surfaces in their functional environment cause deterioration of such surfaces as a result of the formation of rust and corrosion.

It is also known that water is a common contaminant in crankcase lubricants for engines. It may result from the oxidation of the lubricating oil or come from the combustion chamber as a blow-by product of the burning fuel. The presence of this water, in addition to causing rust and corrosion, also seems to promote the deposition of a mayonnaise-like sludge. This type of sludge is even more objectionable in that it clings tenaciously to metal surfaces and is not removed through filtering.

To overcome the corrosive nature of lubricants and normally liquid fuels and to improve the dispersant properties of lubricants, it is common practice to add to such lubricants and fuels minor proportions of anti-corrosion and dispersant material. Many materials have been developed for these purposes including, for example, imidazoline salts of mono- and dicresyl phosphates (U.S. Pat. No. 3,736,110), mixtures of alkyl or alkenyl succinic acid and N-aminoalkyl or N-hydroxyalkyl substituted imidazoline salts of alkyl or alkenyl succinic acids (U.S. Pat. No. 3,282,836), metal alkyl or alkoxy metal alkyl, ester tetrapropenyl succinates (U.S. Pat. No. 3,485,858), and polymerized olefin substituted succinic acid esters (U.S. Pat. No. 3,381,022), to name but a few and the search continues for others.

SUMMARY OF THE INVENTION

In the broadest sense, the additive compositions of the present invention are reaction products prepared by the interreaction of a mixture of reactants comprising (A) at least one unsubstituted or aliphatic hydrocarbon based substituted succinic acylating agent and (B) at least one ether amine of the formula $$RO\text{-}(CH_2)_n\text{-}NH_2$$

where n is a number ranging from one to about 6 and R is a hydrocarbon based radical. In a more preferred embodiment the additive compositions of the present invention are reaction products prepared by the interreaction of a mixture of reactants comprising (A) an aliphatic hydrocarbon based substituted succinic acylating agent wherein the aliphatic hydrocarbon based substituent is a straight-chain or branched-chain alkyl or alkenyl radical containing from about 4 to about 100 carbon atoms and (B) an ether amine of the formula and R is an aliphatic hydrocarbon based radical containing from 1 to about 26 carbon atoms. In yet a more preferred embodiment the additive compositions of this invention are products prepared by the interreaction of a mixture of reactants comprising (A) an alkenyl substituted succinic acylating agent wherein the alkenyl substituent contains from 8 to 30 carbon atoms and (B) an ether amine of the formula above wherein n is a number ranging from about 2 to about 4 and R is a straight-chain or branched-chain alkyl radical containing from about 8 to about 22 carbon atoms. In yet a more preferred embodiment the additive compositions of this invention are reaction products prepared by the interreaction of a mixture of reactants comprising (A) an alkenyl substituted succinic acylating agent wherein the alkenyl substituent contains from about 9 to about 15 carbon atoms and (B) an ether amine of the above formula wherein n is a number ranging from about 2 to about 4 and R is a straight-chain or branched-chain alkyl radical containing from about 10 to about 15 carbon atoms. In a most preferred embodiment the additive compositions of the present invention are products prepared by the interreaction of a mixture of reactants comprising (A) alkenyl substituted succinic anhydride wherein the alkenyl substituent contains about 12 carbon atoms and (B) an ether amine of the formula above where n is the number 3 and R is a branched-chain alkyl radical containing about 13 carbon atoms.

Further embodiments of this invention include lubricants and normally liquid fuel compositions comprising a major proportion of the lubricant or normally liquid fuel and a minor proportion of the additive compositions defined and described herein and to concentrates of said additive compositions.

As used herein, the term "hydrocarbon-based radical" denotes a radical having a carbon atom directly attached to the remainder of the molecule and having predominantly hydrocarbon character within the context of this invention. Such radicals include the following:

(1) Hydrocarbon radicals; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic radicals, and the like, as well as cyclic radicals wherein the ring is completed through another portion of the molecule (that is, any two indicated substituents may together form an alicyclic radical). Such radicals are known to those skilled in the art; examples include methyl, ethyl, propyl, butyl, octyl, decyl, dodecyl, cyclohexyl, phenyl, tolyl, benzyl and the like.

(2) Substituted hydrocarbon radicals; that is, radicals containing non-hydrocarbon substituents which, in the context of this invention, do not alter the predominantly hydrocarbon character of the radical. Those skilled in the art will be aware of suitable substituents (hydroxy, alkoxy, nitro, carbalkoxy).

(3) Hetero radicals; that is, radicals which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

DETAILED DESCRIPTION OF THE INVENTION

The additive compositions of the present invention are complex products obtained by the interreaction of at least two separate components. Component (A) is an unsubstituted or aliphatic hydrocarbon based substituted succinic acylating agent and component (B) an ether amine.

The unsubstituted and aliphatic hydrocarbon based substituted succinic acylating agents, component (A), useful in preparing the additive compositions of this invention are the unsubstituted and aliphatic hydrocarbon based substituted succinic acids and anhydrides thereof having the following structural formulas Anhydride Acid

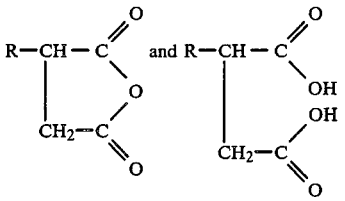

where R' is hydrogen or an aliphatic hydrocarbon based radical containing from about 4 to about 100 carbon atoms, preferably from about 8 to about 30 carbon atoms and most preferably from about 9 to about 15 carbon atoms. Although the source of the aliphatic hydrocarbon based substituent is not a critical aspect of the invention, this substituent will generally be derived from various olefinic monomers such as ethylene, propylene, butylene, hexene, octene, decene, etc., including the oligomers, prepolymers and low molecular weight polymers formed from the foregoing monomers. Thus dimers, trimers and/or tetramers of polymers and butylene can be used.

The aliphatic hydrocarbon based substituted succinic acylating agents, component (A), are the preferred acylating agents for use in preparing the additive compositions of this invention. They are well-known and can be prepared by known procedures. One particularly useful procedure is to react a monoolefin monomer or oligomer as described above with maleic anhydride at 100° C. to 200° C. with or without a catalyst to form the corresponding substituted succinic anhydride. The mono-olefin can be unsaturated in the alpha position such as in 1-butene, 1-hexene, 1-octene and 1-decene, or in a medial position such as in 2-butene, 3-pentene, 4-octene and the like. The same is true of the oligomers. The monomer also can be replaced by an alkyl halide which is capable of being substituted onto the unsaturated anhydride or the equivalent free acid thereof.

The aliphatic hydrocarbon based substituent can be saturated or unsaturated, straight-chain or branched-chain and may contain polar groups provided, however, that such groups are not present in significantly large proportions as to alter the hydrocarbon character of the substituent. Polar groups are typified by halo, carbonyl, nitro and similar groups.

The ether amines, component (B), that can be employed to prepare the additive compositions of this invention are represented by the formula;

$$RO\text{-}(CH_2)_n NH_2$$

where n is a number ranging from about 1 to about 6 and R is a hydrocarbon based radical. Preferably n is a number ranging from about 2 to about 4 and R is preferably a saturated or unsaturated, straight-chain or branched-chain aliphatic hydrocarbon based radical containing from 1 to about 26 carbon atoms. More preferred ether amines are those wherein n is a number ranging from about 2 to about 4 and preferably is the number 3 and R contains from about 8 to about 22 carbon atoms and preferably from about 9 to about 15 carbon atoms. Typical of the ether amines corresponding to the above formula useful in preparing the additive compositions of the present invention is the series of ether amines available commercially from the Mars Chemical Corp. of Atlanta, Ga. sold under the trademark, SURFAM. TM The ether amines useful in the preparation of the additive compositions of this invention can themselves be prepared by any one of a number of well known procedures or methods. Such procedures or methods are fully described in Kirk-Othmer, *Encyclopedia of Chemical Technology,* Third Edition, Vol. 7, pp. 370–374; *Compendium of Organic Synthetic Methods,* March 1971 by I. T. Harrison and S. Harrison at page 262 and *Comprehensive Organic Chemistry,* Vol. 2, pp. 104–110, Pergamon Press (1979) the teachings of which are incorporated herein by reference.

The additive compositions of the present invention may be readily prepared by heating mixtures of the unsubstituted or aliphatic hydrocarbon based substituted succinic acylating agent, component (A), with the ether amine, component (B), at elevated temperatures ranging from about 45° C., to about 250° C. A more preferred range of reaction temperatures is from about 60° C., to about 180° C. particularly where it is preferred that the desired additive composition be of the amide or imide type. Below about 55° C. the additive compositions are believed to be predominately salts or amidic acid salts. Above about 55° C., the amide and imide types of structures are believed to predominate, The molar ratio of component (A) to component (B) in the mixture of reactants can range from about 1.0:0.5 to about 1.0:3.0. The preferred molar ratio ranges from about 1.0:1.0 to about 1.0:2.0.

The additive compositions of this invention can be prepared either in the absence or presence of a solvent. Preferably the additive compositions of this invention are prepared in the presence of a solvent. Solvents suitable for use in the reaction may be hydrocarbon or polar solvents such as, for example, benzene, naphtha, toluene, xylene, n-hexane, dioxane, chlorobenzene, kerosene, gasoline or a fuel oil and oils of lubricating viscosity.

The exact chemical constitution of the additive compositions of this invention are not known with certainty although from the nature of the starting reactants used and the reaction conditions employed salts, amidic acid salts, amide and imide type compositions and mixtures thereof are believed to be obtained as indicated above.

Following are examples illustrating preparations of the additive compositions of this invention. All parts are by weight unless otherwise specified.

EXAMPLE 1

Two hundred and ninety-two parts of tetrapropanyl substituted succinic anhydride (prepared by reacting maleic anhydride with a polypropylene tetramer) and two hundred and fifty parts xylane are charged to a reactor equipped with a stirrer, thermometer and a Dean-Stark water trap. Two hundred and fifty eight parts of SURFAM TM p17AB (branched $C_{13}$ ether amine obtained from Mars Chemical Corp., Atlanta, Ga.) is added to the xylene-succinic anhydride mixture at room temperature, and is allowed to exotherm to 52° C. The temperature is increased to 150° C., and held at a 130°-150° C. for two hours. Twenty five parts additional SURFAM TM P17AB is then added to the reacting mixture at this point. A small amount of water is collected in the Dean-Stark tube. Seventeen parts additional SURFAM TM P17AB is added and the mixture is heated for an additional hour. The xylene is stripped and the final product is filtered and collected. The acid neutralization number to phenolphthalein as determined by ASTM procedure D-974, is 4.6.

EXAMPLE 2

Nine hundred and five parts of an alkylated succinic anhydride, prepared by reacting maleic anhydride with a $C_{15}$-$C_{18}$ alpha olefin, and three hundred parts of toluene are charged to a reactor as described in Example 1. Four hundred and eighty-four parts of SURFAM TM P10A (a linear $C_6$ ether amine obtained from Mars Chemical Corp., Atlanta, Ga.) is added from a dropping funnel while heating. After all the SURFAM TM P10A is added, heating is continued under a nitrogen purge. During this time, 56 parts of byproduct is removed by azeotropic distillation. The toluene is stripped from the reaction mixture at 160° C. at 5 torr and the final product is filtered and collected. The acid neutralization number to phenolphthalein as determined by ASTM procedure D-974, is 17.

EXAMPLE 3

Two hundred and sixty five parts of polyisobutenyl (molecular weight about 900) succinic anhydride (prepared by reacting maleic anhydride with chlorinated polyisobutene) is charged to a reactor equipped with a stirrer, thermometer, Dean-Stark trap, nitrogen inlet and an additon funnel and heated to 105° C. Then 95 parts of a mixed $C_8$-$C_{10}$ primary ether amine (from Ashland Chemical Co.) is added over a period of 0.4 hour at 105°-131° C. under nitrogen purge. The reaction is continued under nitrogen purge and with stirring for six hours at 131°-152° C. A distillate consisting of 3 milliliters of an aqueous phase and 5 to 10 milliliters of an organic phase is collected in the Dean-Stark trap during this time. The base neutralization number of the reaction mixture to bromophenol blue is 20.8. One hundred and thirty seven parts of additional polyisobutenyl succinic anhydride is then added and mixed at 150°-155° C. under nitrogen purge for 2 hours. Two parts of additional aqueous distillate are collected. The product formed is filtered and collected. The neutralization numbers are 0.5 basic to bromophenol blue and 5.7 acid to phenolphthalein.

EXAMPLE 4

One hundred parts of succinic anhydride and ninety parts of mineral oil as diluent are added to a reactor equipped with a stirrer, thermometer, nitrogen inlet and Dean-Stark trap. Two hundred and fifty-eight parts of SURFAM TM P17AB as described in Example 1 are added dropwise over a two hour period during which time exothermic reaction occurs. After addition is completed, the reaction mixture is heated to 160° C. with a nitrogen purge until 18 milliliters of by-product water are collected in the Dean-Stark trap. The product obtained is then filtered and collected. The acid neutralization number is 16.8.

EXAMPLE 5

Sixty parts of succinic anhydride and one hundred parts of xylene are added to a reactor equipped with a stirrer, thermometer and condenser. Three hundred and twenty parts of SURFAM TM P17AB are added dropwise over a one hour period during which time the temperature rises exothermically to 48° C. After addition is complete, stirring is continued for two hours. The solution is filtered and then stripped at a temperature of 150° C. and pressure of 15 torr. The product has neutralization numbers of 38 acid to phenolphthalein and 49 basic to bromophenol blue.

EXAMPLE 6

One hundred parts of succinic anhydride and one hundred parts of xylene are added to a reactor as described in Example 5. Five hundred and forty-two parts of SURFAM TM P17AB are added dropwise over two hours during which time exothermic reaction occurs. The reaction mixture is stirred, for two more hours. The solution is filtered then stripped to 80°-85° C. at 0.1 torr, then refiltered and collected. The product obtained has neutralization numbers of 86 acid to phenolphthalein and 91 basic to bromophenol blue.

EXAMPLE 7

To a reactor as described in Example 5 are charged one hundred parts of succinic anhydride and two hundred and fourteen parts of xylene. Five hundred and forty-two parts of SURFAM TM P17AB is added dropwise over a one hour period while the temperature rises to 45° C. The solution is stirred without additional heating for one hour then filtered and collected. The filtered xylene solution of product has neutralization numbers of 84 acid to phenolphthalein and 80 basic to bromophenol blue.

EXAMPLE 8

Two hundred and sixty-six parts of the tetrapropenyl substituted succinic anhydride of Example 1 is charged to a reactor as described in Example 5. Five hundred and sixteen parts of SURFAM TM P17AB is added dropwise over a three hour period while the temperature rises exothermically to 52° C. The reaction mixture is stirred for an additional hour at 46°-55° C. at the end of which time the product is filtered and collected. The filtered product has neutralization numbers of 76 acid to phenolphthalein and 66 basic to bromophenol blue.

EXAMPLE 9

Four hundred and fifty parts of an oil solution of tetrapropenyl substituted succinic acid (prepared by reacting tetrapropenyl substituted succinic anhydride with water) are charged to a reactor equipped with a stirrer, thermometer, reflux condenser and addition funnel. Five hundred and sixteen parts of SURFAM TM P17AB are then added from the addition funnel while the temperature exotherms to 59° C. The reaction mixture is stirred without heating for two hours then filtered and collected. The product obtained has neutralization numbers of 108 acid to phenolphthalein and 102 basic to bromophenol blue.

EXAMPLE 10

Two hundred and thirty-six parts of succinic acid and one liter xylene are charged to a reactor equipped with a stirrer, thermometer, addition funnel and Dean-Stark trap, Starting at room temperature, five hundred and fourteen parts SURFAM TM P17AB are added dropwise over 0.5 hour while the temperature increases to 32° C. The reaction mixture is then heated to reflux while water is removed by azeotropic distillation (36 parts water is collected). The material is stripped at 70° C. and 8 torr, filtered and collected. The product obtained had neutralization numbers of 123 acid to phenolphthalein and 31 to bromophenol blue.

EXAMPLE 11

Five hundred and and thirty-two parts of tetrapropenyl substituted succinic anhydride and 7.2 parts of water are charged to a reactor equipped with a stirrer, thermometer, nitrogen inlet and condenser. While stirring and purging with nitrogen the materials are heated to 98° C. and reacted at 98°–100° C. for 2.5 hours. Six hundred and sixty-six parts of xylene is then added to the reaction mixture at room temperature. While stirring and purging with nitrogen, one thousand and ninety-two parts of SURFAM TM P18A (linear $C_{14}$ ether amine obtained from Mars Chemical Corp.) are added dropwise over 2.5 hours while the temperature exotherms to about 45° C. After the addition is complete, stirring is continued until the mixture returns to 26° C. The xylene solution of product has neutralization numbers of 57 acid to phenolphthalein and 61 basic to bromophenol blue.

EXAMPLE 12

The procedure of Example 11 is followed except SURFAM TM P17AB is used. The xylene solution obtained has neutralization numbers of 53 acid to phenolphthalein and 65 basic to bromophenol blue.

Another embodiment of this invention is fuel compositions containing a minor proportion of the above described additives. The major proportion of the fuel composition comprises a normally liquid fuel, usually a hydrocarbonaceous petroleum distillate fuel such as motor gasoline as defined by ASTM Specification D439 and diesel fuel or fuel oil as defined by ASTM Specification D396. Normally liquid fuel compositions comprising non-hydrocarbonaceous materials such as alcohols, ethers, organonitro compounds and the like (e.g., methanol, ethanol, hydrated ethanol, diethyl ether, methyl ethyl ether, nitromethane) are also within the scope of this invention as are liquid fuels derived from vegetable or mineral sources such as corn, alfalfa, shale and coal. Normally liquid fuels which are mixtures of one or more hydrocarbonaceous fuels and one or more non-hydrocarbonaceous materials are also contemplated. Examples of such mixtures are combinations of gasoline and ethanol, both hydrated and substantially anhydrous ethanols, and of diesel fuel and ether. Particularly preferred is gasoline, that is, a mixture of hydrocarbons having an ASTM distillation range from about 60° C. at the 10% distillation point to about 205° C. at the 90% distillation point, both hydrated and substantially anhydrous ethanols and mixtures of gasoline and said ethanols or methanol.

Generally, these fuel compositions contain an amount of the additive compositions of this invention sufficient to provide it with anti-corrosion properties; usually this amount is about 0.5 to about 2500 parts by weight, preferably 10 to 1000 parts, of the composition of this invention per million parts of fuel.

The fuel composition can contain, in addition to the composition of this invention, other additives which are well known to those of skill in the art. These include antiknock agents such as tetraalkyl lead compounds, methylt-butyl ether, mixtures of methyl alcohol and t-butyl alcohol, lead scavengers such as haloalkanes (e.g., ethylene dichloride and ethylene dibromide), deposit preventers or modifiers such as triaryl phosphates, dyes, octane improvers, antioxidants such as 2,6-di-tertiary-butyl-4-methylphenol, bacteriostatic agents, gum inhibitors, metal deactivators, demulsifiers, upper cylinder lubricants and anti-icing agents.

In certain preferred fuel compositions the compositions of this invention are combined with an ashless dispersant in gasoline. Suitable ashless dispersants include esters of mono- or polyols and high molecular weight mono- or polycarboxylic acid acylating agents containing at least 30 carbon atoms in the acyl moiety. Such esters are well known to those skilled in the art. See, for example, French Patent No. 1,396,645, British Patent Nos. 981,850; 1,055,337 and 1,306,529; and U.S. Pat. Nos. 3,255,108; 3,311,558; 3,331,776; 3,346,354; 3,522,179; 3,579,450; 3,542,680; 3,381,022; 3,639,242; 3,697,428 and 3,708,522. These patents are expressly incorporated herein by reference for their disclosure of suitable esters and methods for their preparation. Generally, the weight ratio of the composition of this invention to the aforesaid ashless dispersant is between about 0.1:1 and about 10:1, preferably between about 1:1 and about 10:1.

The compositions of this invention can be added directly to the fuel, or they can be diluted with a substantially inert, normally liquid organic diluent such as naphtha, benzene, toluene, xylene or a normally liquid fuel as described above, to form an additive concentrate. These concentrates which constitute yet another embodiment of the present invention generally contain from about 20% to about 90% by weight of the composition of this invention and may contain, in addition one or more other conventional additives known in the art or described hereinabove.

As previously indicated, the composition of this invention are also useful as additives for lubricants. They can be employed in a variety of lubricants based on diverse oils of lubricating viscosity, including natural and synthetic lubricating oils and mixtures thereof. These lubricants include crankcase lubricating oils for spark-ignited and compression-ignited internal combustion engines, including automobile and truck engines, two-cycle engines, aviation piston engines, marine and railroad diesel engines, and the like. The compositions can also be used in gas engines, stationary power engines and turbines and the like. Automatic transmission fluids, transaxle lubricants, gear lubricants, metal-working lubricants, hydraulic fluids and other lubricating oil and grease compositions can also benefit from the incorporation therein of the compositions of this invention.

Natural oils include liquid petroleum oils and solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins [e.g., polybutylenes, polypropylenes, propylene-isobutylene copolymers, chlorinated polybutylenes, poly(1-hexenes), poly(1-octenes), poly(1-decenes)], alkylbenzenes [e.g., dodecylbenzenes, tetradecylbenzenes, dinonylbenzenes, di(2-ethylhexyl)benzenes]; polyphenyls (e.g., biphenyls, terphenyls, alkylated polyphenyls), and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of polyethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azalaic acid, suberic acid, sebacic acid, fumaric acid, adipic acid, linoleic acid dimer, malonic acid, alkyl malonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioetyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl- polyaryl-, polyalkoxy-, or polyaryloxysiloxane oils and silicate oils comprise another useful class of synthetic lubricants; they include tetraethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy) disiloxane, poly(methyl)siloxanes and poly (methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or snythetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

Generally, the lubricants of the present invention contain an amount of the additive compositions of this invention sufficient to provide it with anti-corrosion and dispersant properties. Normally this amount will be about 0.05 percent to about 10.0 percent by weight and preferably from about 0.1 percent to about 5.0 percent by weight of the additive compositions of this invention based on the weight of the lubricant.

Illustrative of the fuel compositions of this invention are gasolines, substantially anhydrous ethanol, hydrated ethanol and methanol or mixtures thereof containing 800 parts per million of the additive compositions of Examples 1 through 12. Illustrative of the lubricant composition of this invention are crankcase lubricants containing 2.0 percent by weight and turbine oils containing 0.1 percent by weight of the additive compositions of Examples 1 through 12.

What is claimed is:

1. An additive composition for use in lubricants comprising the reaction product of a mixture of reactants comprising (A) an alkenyl substituted succinic acylating agent where the alkenyl substituent contains from about 8 to about 30 carbon atoms and (B) an ether amine of the general formula:

$$RO\text{-}(CH_2)_nNH_2$$

where n is a number ranging from about 2 to about 4 and R is a straight-chain or branched-chain alkyl radical containing from about 8 to about 22 carbon atoms.

2. The composition of claim 1 wherein reactant (A) is alkenyl substituted succinic anhydride wherein said alkenyl substituent contains from about 9 to about 15 carbon atoms.

3. The composition of claim 1 wherein reactant (B) is an ether amine of the general formula:

$$RO\text{-}(CH_2)_nNH_2$$

where R contains from 10 to 15 carbon atoms.

4. The composition of claim 2 wherein reactant (A) is alkenyl substituted succinic anhydride wherein said alkenyl substituent contains about 12 carbon atoms.

5. The composition of claim 3 wherein reactant (B) is an ether amine corresponding to the general formula:

$$RO\text{-}(CH_2)_nNH_2$$

where n is the integer 3 and R is a branched-chain alkyl radical containing 13 carbon atoms.

6. An additive composition for use in lubricants comprising the reaction product of a mixture of reactants comprising (A) alkenyl substituted succinic anhydride wherein the alkenyl substituent contains from about 9 to about 15 carbon atoms and (B) ether amines of the general formula:

$$RO\text{-}(CH_2)_nNH_2$$

where n is a number ranging from about 2 to about 4 and R is a straight-chain or branched-chain alkyl radical containing from 10 to 15 carbon atoms.

7. The composition of claim 6 wherein reactant (A) is alkenyl substituted succinic anhydride wherein the alkenyl substituent contains about 12 carbon atoms.

8. The composition of claim 6 wherein reactant (B) is an ether amine of the general formula:

$$RO\text{-}(CH_2)_nNH_2$$

where n is the number 3 and R is a branched-chain alkyl radical containing about 13 carbon atoms.

9. An additive composition for use in lubricants comprising the reaction product of a mixture of reactants comprising (A) an alkenyl substituted succinic anhydride wherein the alkenyl substituent contains about 12 carbon atoms and (B) an ether amine of the formula $$RO\text{-}(CH_2)_nNH_2$$

where n is the number 3 and R is a branched-chain alkyl radical containing about 13 carbon atoms.

10. A lubricant composition comprising a major proportion of a lubricant and a minor proportion of at least one additive composition comprising the reaction product of a mixture of reactants comprising (A) an alkenyl substituted succinic acylating agent where the alkenyl substituent contains from about 8 to about 30 carbon atoms and (B) an ether amine of the general formula:

$$RO\text{-}(CH_2)_nNH_2$$

where n is a number ranging from about 2 to about 4 and R is a straight-chain or branched-chain alkyl radical containing from about 8 to about 22 carbon atoms.

11. The composition of claim 10 in which the additive composition comprises the reaction product of the mixture of reactants (A) and (B) wherein reactant (A) is alkenyl substituted succinic anhydride wherein the alkenyl substituent contains from about 9 to about 15 carbon atoms.

12. The composition of claim 10 in which the additive composition comprises the reaction product of the mixture of reactants (A) and (B) wherein reactant (B) is an ether amine of the general formula:

$$RO\text{-}(CH_2)_nNH_2$$

where R contains from 10 to 15 carbon atoms.

13. The composition of claim 11 in which the additive composition comprises the reaction product of the mixture of reactants (A) and (B) wherein reactant (A) is alkenyl substituted succinic anhydride wherein the alkenyl substituent contains about 12 carbon atoms

14. The composition of claim 12 in which the additive composition comprises the reaction product of the mixture of reactants (A) and (B) wherein reactant (B) is an ether amine corresponding to the general formula:

$$RO\text{-}(CH_2)_nNH_2$$

where n is the integer 3 and R is a branched-chain alkyl radical containing 13 carbon atoms.

15. A lubricant composition comprising a major proportion of a lubricant and a minor proportion of at least one additive composition comprises the reaction product of a mixture of reactants comprising (A) alkenyl substituted succinic anhydride wherein the alkenyl substituent contains from about 9 to about 15 carbon atoms and (B) an ether amine of the general formula:

$$RO\text{-}(CH_2)_nNH_2$$

where n is a number ranging from about 2 to about 4 and R is a straight-chain or branched-chain alkyl radical containing from 10 to 15 carbon atoms.

16. The composition of claim 15 in which the additive composition comprises the reaction product of the mixture of reactants (A) and (B) wherein reactant (A) is alkenyl substituted succinic anhydride wherein the alkenyl substituent contains about 12 carbon atoms.

17. The composition of claim 15 in which the additive composition comprises the reaction product of the mixture of reactants (A) and (B) wherein reactant (B) is an ether amine corresponding to the general formula:

$$RO\text{-}(CH_2)_nNH_2$$

where n is the number 3 and R is a branched-chain alkyl radical containing 13 carbon atoms.

18. A lubricant composition comprising a major proportion of a lubricant and a minor proportion of an additive composition comprising the reaction product of a mixture of reactants comprising (A) alkenyl substituted succinic anhydride wherein the alkenyl substituent contains about 12 carbon atoms and (B) an ether amine of the general formula:

$$RO\text{-}(CH_2)_nNH_2$$

where n is a number 3 and R is a branched-chain alkyl radical containing 13 carbon atoms.

19. A concentrate comprising a normally liquid diluent and from 20 to 90 percent by weight of an additive composition of claim 1.

20. A concentrate comprising a normally liquid diluent and from 20 to 90 percent by weight of an additive composition of claim 6.

21. A concentrate comprising a normally liquid diluent and from 20 to 90 percent by weight of the additive composition of claim 9.

* * * * *